US005370397A

United States Patent [19]

Miller, Jr. et al.

[11] Patent Number: 5,370,397

[45] Date of Patent: Dec. 6, 1994

[54] BACKGAMMON BOARD WITH CHANGEABLE PLAYING SURFACE

[76] Inventors: Daniel C. Miller, Jr., 4 Blevens Dr., Concord, N.H. 03301; Daniel C. Miller, Sr., 42 Thompson Park, Franklin, N.H. 03235

[21] Appl. No.: 111,669

[22] Filed: Aug. 25, 1993

[51] Int. Cl.[5] ..... A63F 3/00

[52] U.S. Cl. ..... 273/283; 273/284; 273/287; 273/248

[58] Field of Search ..... 273/283–287, 273/241, 260, 248; D21/24, 23

[56] References Cited

U.S. PATENT DOCUMENTS

| | | | |
|---|---|---|---|
| 163,630 | 5/1875 | Bourn | 273/284 |
| 250,458 | 12/1881 | Shay | 273/284 |
| 509,316 | 11/1893 | Lapham | 273/284 |
| 2,424,123 | 7/1947 | Schruben | 273/285 |
| 3,610,626 | 10/1971 | Nolte | 273/283 |
| 4,984,808 | 1/1991 | Young | 273/285 |

*Primary Examiner*—Benjamin H. Layno
*Attorney, Agent, or Firm*—William B. Ritchie

[57] ABSTRACT

An improved Backgammon playing board that has easily changeable playing surface inserts. The playing board inserts can be printed in accordance with the players stylistic preferences. For example, players who enjoy the variant of the Backgammon called Acey-deucey would most likely enjoy a military motif since many such players learned the game while in the Marines or Merchant Marine. The board also features a unique bar that stores the dice, checkers and doubling die. The bar also features a ramp that automatically places a checker within easy reach whenever one is removed from the bar.

4 Claims, 6 Drawing Sheets

BACKGAMMON BOARD WITH CHANGEABLE PLAYING SURFACE

BACKGROUND OF THE INVENTION

1. Field of the Invention

The invention relates to game boards, specifically boards used for playing the game of backgammon.

2. Description of the Related Art

According to Hoyle, the game of Backgammon preceded even the ancient games of Chess and Parcheesi. In fact, the game of Backgammon dates back to before the Greeks and Roman periods. In England around 1750, the rules of Backgammon were established by Edmund Hoyle. The only change to the present day has been the introduction of the doubling cube 65 (See FIG. 1 for Backgammon equipment) which significantly increased the reward for skillful playing. The playing surface 14' is square or rectangular, consisting of 24 triangles, called points 12'. The 24 triangles are divided into four quadrants of six triangles each. Separating the quadrants is the spine of the board which is referred to as the bar 16. The quadrants are defined as a player's home or inner board and his outer board and the opponent's home and outer board. The triangles alternate in color. Each player is provided with 15 checkers 62 and 66 of differing colors. Two dice cups (not shown), four dice 64 and doubling cube 65 complete the equipment list.

The game is essentially a race to be the first player to move all his/her checkers to his/her home board and then to "bear off", that is, to remove his/her checkers from the board wins the game. There are numerous variations of the play by which the objective is achieved. The most popular variation involves the use of the doubling cube which shortens the length of play and allows a player to capitalize on a superior position. The use of the doubling cube is particularly well suited for tournament play. Backgammon tournaments are played for prize money and have become particularly popular over the last thirty years. Frequently, the tournaments are used for raising money for charitable organizations.

In addition to the doubling variant, numerous other variants are common. Chouette is a version that enables more than two players to play. Acey-deucey is a favorite Backgammon variant in the U.S. Navy, Marine Corps, and Merchant Marine. Russian Backgammon starts the game with all checkers (called "stones" in this variant) off the game board at the start. Dutch Backgammon also starts in this manner but, unlike Russian Backgammon, stones are entered on the adverse home quadrant or table. Snake is still another variant where one play starts with all stones on the board and the other player starts with nine stones on the bar. In each variation, the terminology for the equipment and moves may vary but the equipment is standard.

Variations in the layout of the points (triangles) has been proposed, U.S. Design Pat. Nos. 260,661 and 261,284, issued to Thomas, are representative of this genre. However, these designs have not achieved commercial success as the traditional layout established for hundreds of years is well entrenched.

Other improvements have sought to enable the board and remaining equipment to be carried in a case. U.S. Design Pat. No. 261,535, issued to Tawil, discloses a combined Backgammon game and carrying case.

Still others have attempted to provide four player capability such as that disclosed by Riley et al. in U.S. Pat. No. 4,854,593 or provide a Backgammon board in combination with other playing surfaces on a cube assembly as disclosed by Oake in U.S. Pat. No. 4,552,362.

However, a Backgammon board that is designed for the traditional rules and equipment, yet makes the game more enjoyable by permitting customized, changeable playing surfaces and an automatic checker dispensing and storage system is not found in the prior art.

SUMMARY OF THE INVENTION

It is an object of the invention to provide a playing board for Backgammon that features easily changeable playing surfaces.

It is another object of the invention to provide a playing board for Backgammon that enables the checkers, dice and doubling die to be conveniently stored on the bar of the board.

It is still another object of the invention to provide a playing board for Backgammon that delivers the checkers to the player automatically after a checker is removed from the bar.

Another object of the invention is to provide a playing board for Backgammon that can having easily changeable playing surfaces of different textures and points of different designs and colors to make the game more enjoyable.

The invention is a game board for playing the game of Backgammon. A base with a top surface is provided. A rectangular frame with an inner perimeter is attached to the based. The frame has a recess at the inner perimeter and adjacent to the top surface of said base. Two flexible inserts, substantially identical, and dimensioned to correspond to the recess of said frame are provided. When said inserts are placed within the frame of said board, said inserts form a Backgammon playing surface that conforms to the commonly accepted format for Backgammon play.

DETAILED DESCRIPTION OF THE INVENTION

Figure 1:
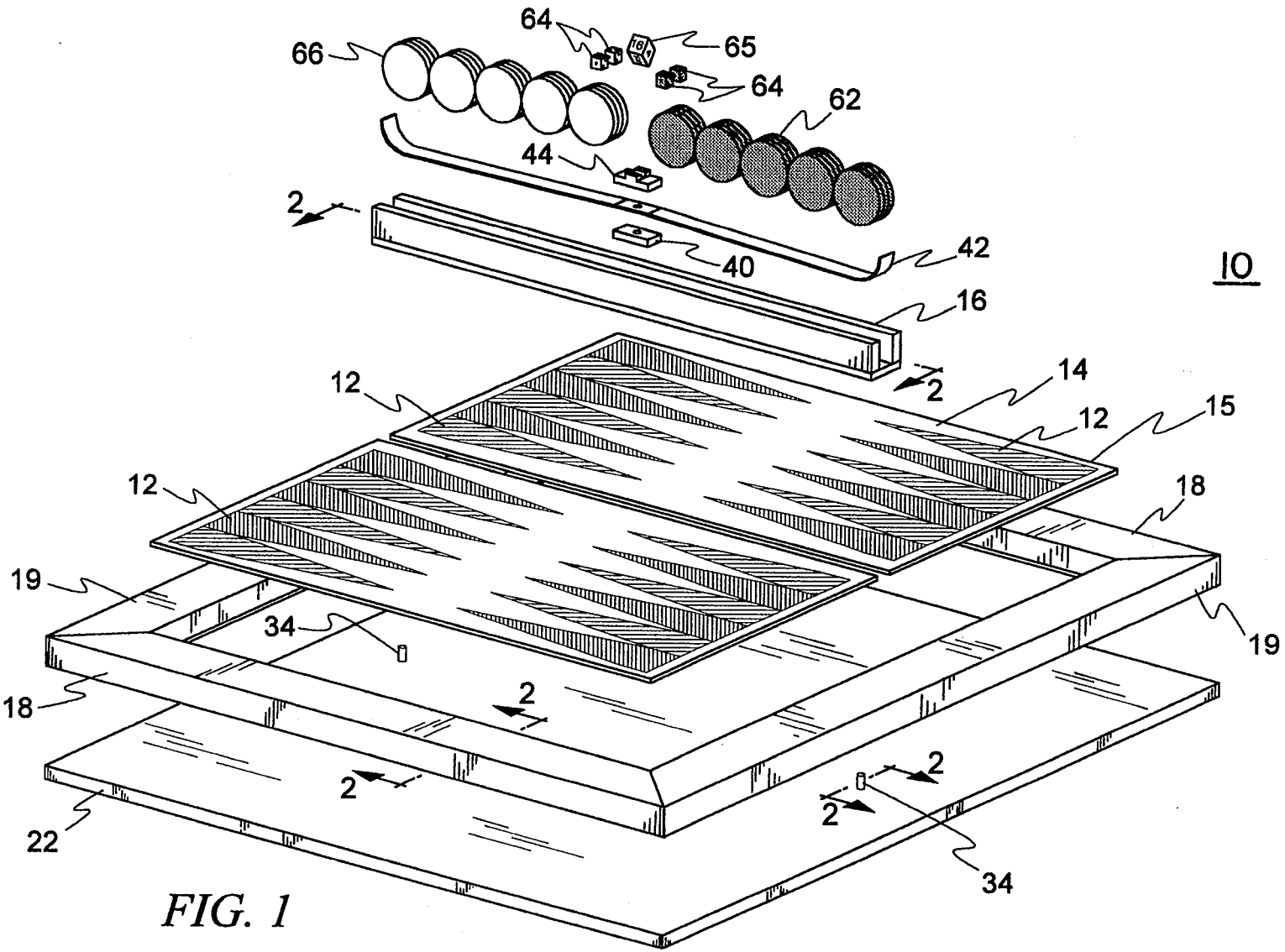
FIG. 1 is an exploded top view of the changeable Backgammon game board in accordance with the invention.

As noted above, the game of Backgammon having been around for at least two thousand years, has a firmly entrenched tradition concerning playing surfaces. However, the inventors recognized that while tradition requires a standard format, it is highly desirable to have a playing surface that can be easily changed to reflect the stylistic tastes of the players. As shown in FIG. 1, playing surface 14' is the traditional format. However, as shown on the left on playing surface 14, points 12 and the remaining surface could be highly decorative while still maintaining a "traditional" arrangement. For example, the border and points of the playing surface might features triangles having stars or planets, comets, etc. to portray an astronomical motif. For those who prefer the LAURA ASHLEY look, points in floral patterns of subdued pastels, and so on. The range of designs is limitless and can be almost custom designed. However, this potential cannot be taken advantage of unless the playing surface can be easily changed. While the inventors originally envisioned this concept for upscale Backgammon playing boards, the structure present herein could easily work for competitively priced sets as well.

FIG. 1 is an exploded top view of the changeable Backgammon game board 10. Playing surface 14' is shown with the traditional number and placement of points 12'. Playing surface 14 is shown with the traditional number and placement of points 12 yet in a highly stylized format. As shown, playing surfaces 14 and 14' are printed on removable inserts 15. Insert 15 is slightly longer in length than the distance between frame lengths 19. Also, insert 15 is slightly wider than is required to fit between frame widths 18. Inserts 15 are positioned within the framework of the invention by pin 34 which locks inserts 15 in place and keeps them shifting. Bar 16 provides storage for each players checkers 62 and 66, playing dice 64 and doulbing die 65. Bar 16 also covers the joint where inserts 15 meet in the center next to pin 34. Thus, when bath portions of insert 15 are in place, a standard arrangement Backgammon playing surface as discussed above is provided.

Figure 2:
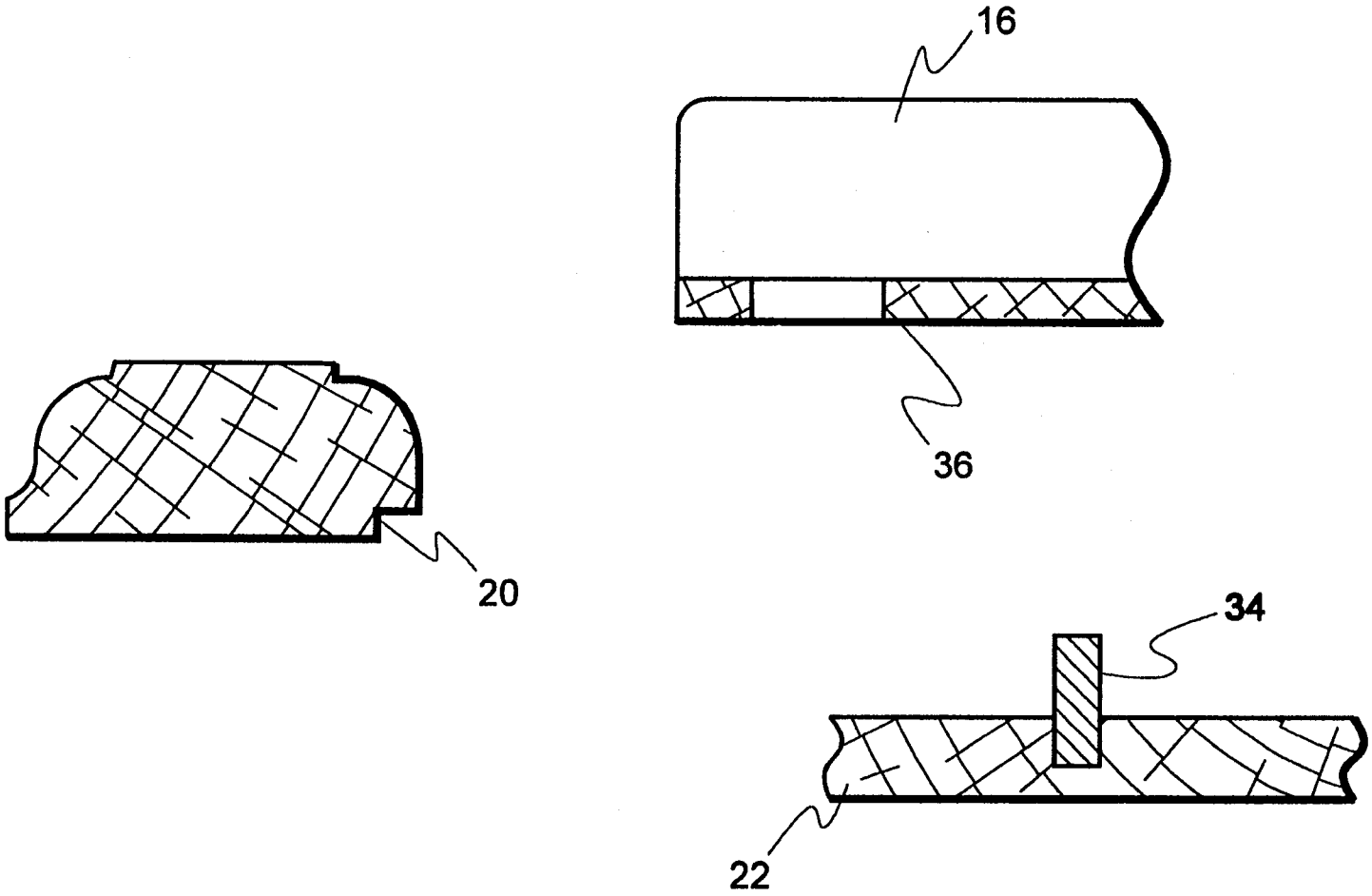
FIG. 2 is a cross-sectional view of the game board frame.
Figure 3:
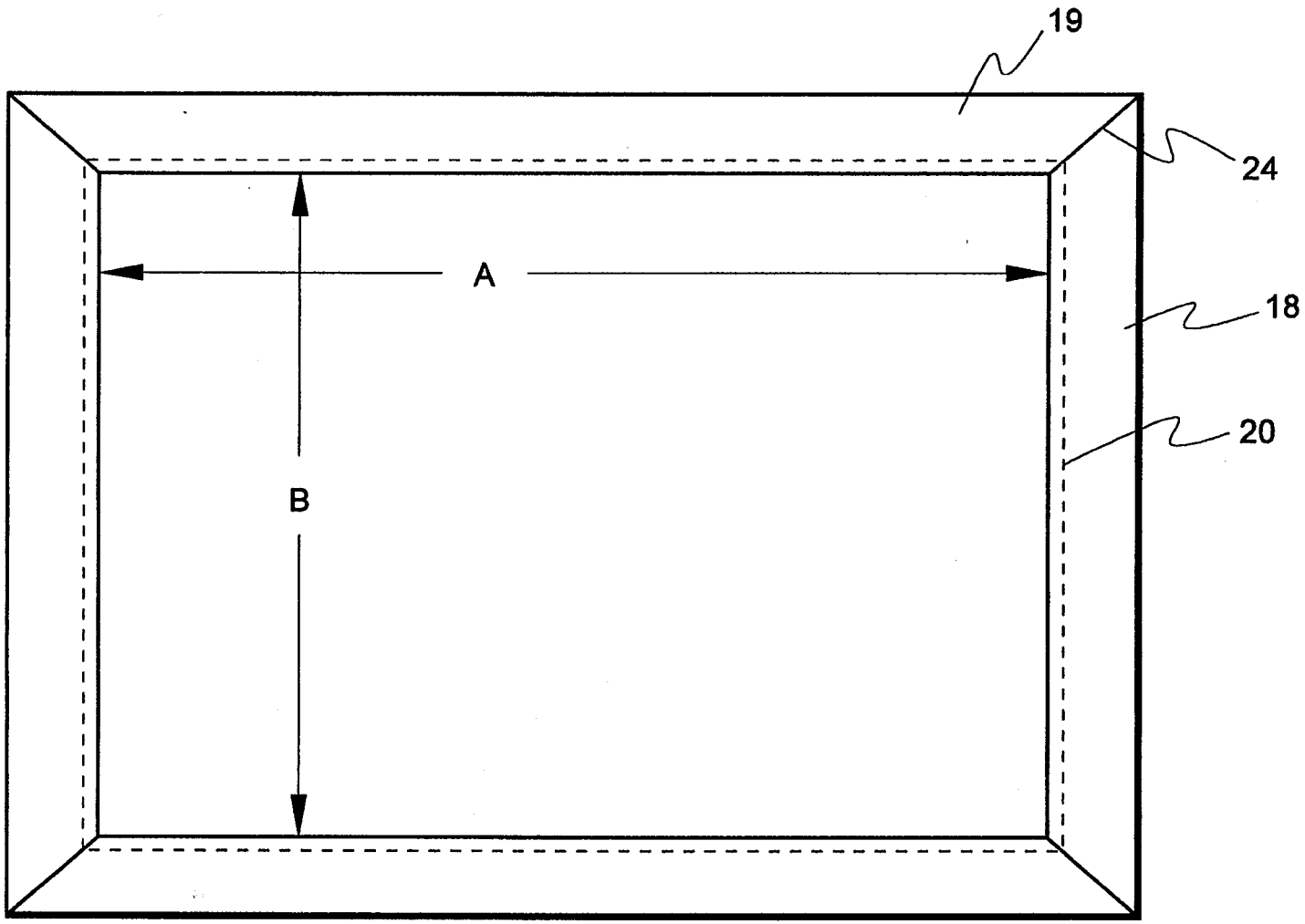
FIG. 3 is a top view of the game board frame.

FIG. 2 is a cross-sectional view of the game board frame length 19. The cross-sectional profile of frame width 18 is identical to frame length 19. While frame parts 18 and 19 are preferably a decorative hardwood such as cherry or mahogany, plastic or inexpensive materials could be substituted and would work as well although lacking the beauty of fine woods. Frame parts 18 and 19 are screwed to base 22. Base 22 is preferably clear plastic such as LEXAN, however, other dimension stable materials would work as well. Recess 20 is cut into frame section 18 and 19. The dimensions of this recess corresponds to the increases in size of insert 15 when compared to the dimension A and dimension B (shown in FIG. 3) of the frame. Typically, recess 20 is about 3/16 inches deep as well as high extending entirely around the interior perimeter of the frame.

Note the dimension A and dimension B are preferably about 20 inches and 17 inches respectively. Also, frame parts 18 and 19 are preferably about 2 inches wide and almost 1 inch thick. However, these dimension are not critical and could be scaled up or down accordingly. These dimensions as well as the others that follow are what the inventors consider appropriate for a Backgammon board that is ideal for tournament play.

Bar 16 is removably attached to base 22 via pin 34 which is inserted into slot 36. Another pin and slot (not shown in this view) is substantially identical and is provided on the other end of bar 16. Bar 16 serves to hold checkers 62 & 66, dice 64 and doubling die 65 as well as cover the joint that occurs when the two inserts are placed within the frame of the apparatus.

Figure 4:
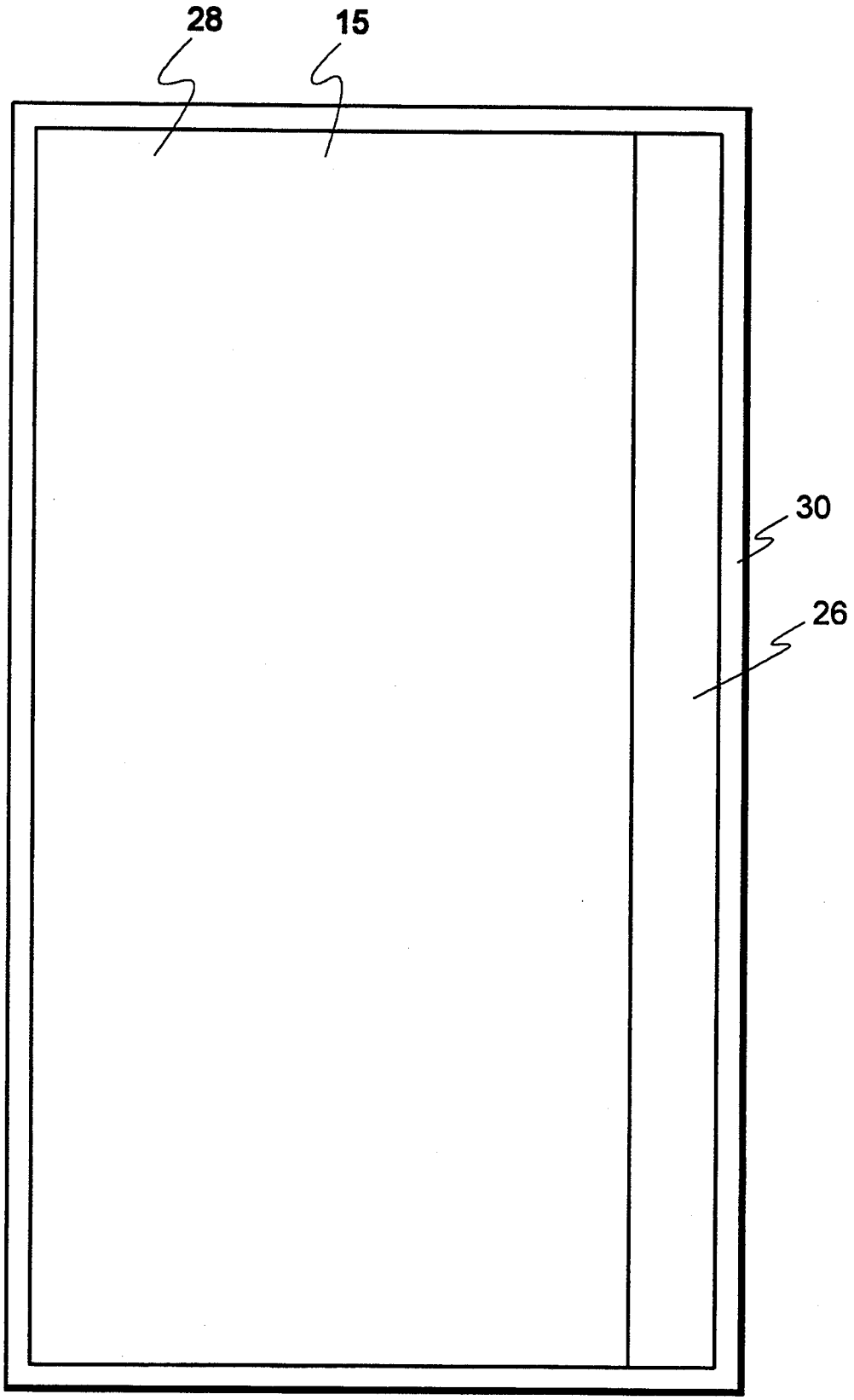
FIG. 4 is a top view of the changeable playing surface insert.

FIG. 4 is a top view of the changeable playing surface insert 15. The preferred embodiment of insert 15 is a laminated printed paper featuring decorative representations of Backgammon points with traditional alternating colors, six points to side, 12 points to an insert. However, within the standard format, an infinite variety of stylistic interpretations is permissible without departing from the above constraints. Preferably, insert 15 is paper printed with a four-color process printed at least in region 28 that is laminated on both sides with a clear plastic covering. The paper could also be backed by cardboard or other such material to give the playing surface a softer feel when the checkers are played thereon. It is also possible to cover a flexible cardboard with a felt surface having points of alternating colors. Other alternatives for insert 15 could be embossed or imprinted leather or buckskin, Naugahyde or other synthetic leatherette material, and vinyl. Any material that is quite flexible and capable of having the necessary playing surface affixed thereon is acceptable.

As long as insert 15 is flexible, it can be easily inserted into recess 20 merely by bending insert 15 more or less in the middle and inserting edge 30 of insert 15 under recess 20. Margin 26 is beneath bar 16 so only region 28 is seen during use. It is also possible to have insert 15 printed on both sides so that a single insert can serve to provide two separate and distinct playing surfaces regions 28. Thus, once a player tires of looking at one surface, he/she merely removes bar 16, removes both inserts 15, turns them over to the other side, and inserts insert 15 under recess 20 of frame sections 18 and 19, and replaces bar 16. In less than a minute, a Backgammon playing board having a completely different appearance is obtained.

Figure 5:
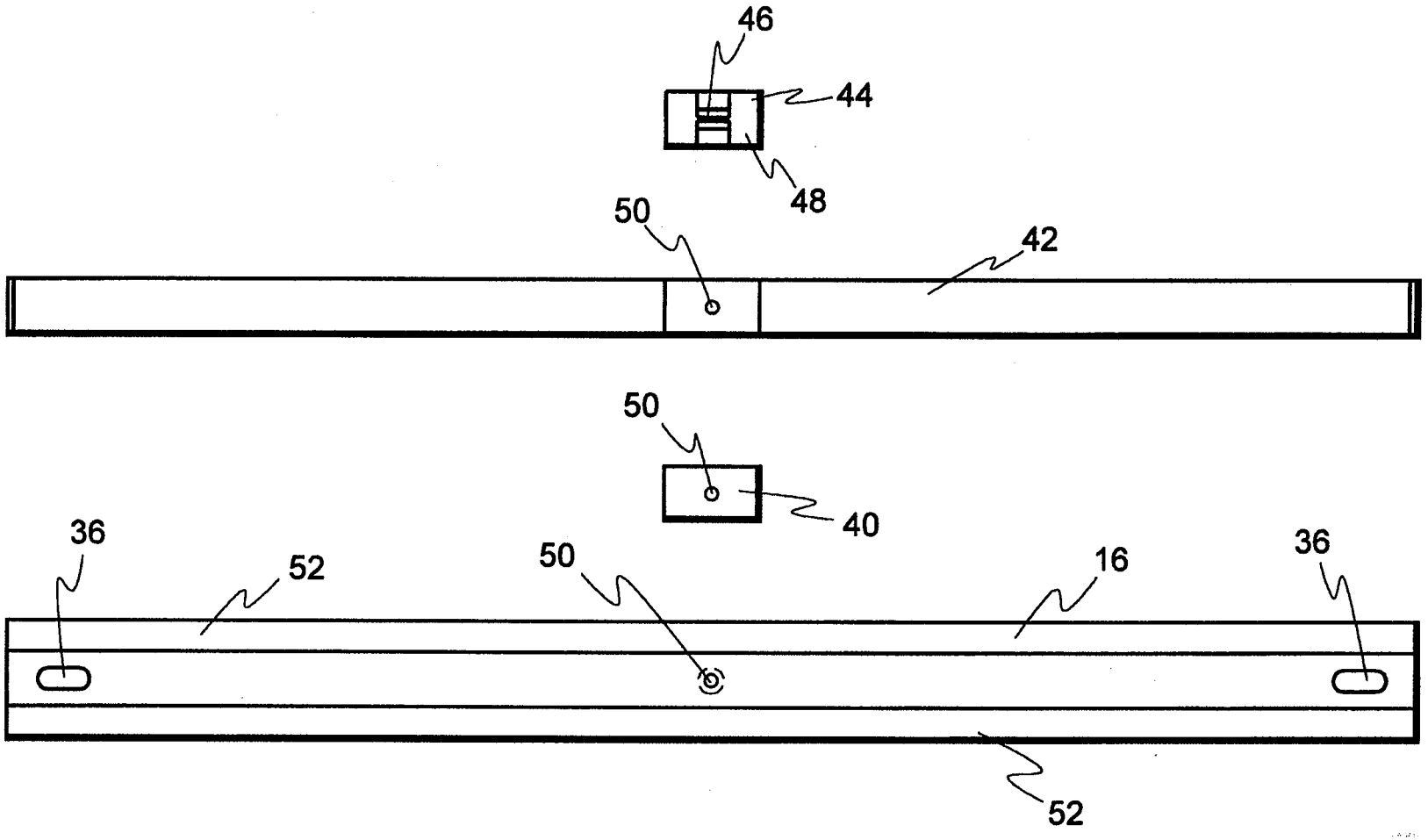
FIG. 5 is an exploded top view of the game board bar.

FIG. 5 is an exploded top view of game board bar 16. Bar 16 is preferably a U-shaped section of wood that matches frames 18 and 19. However, other materials can be substituted as discussed above. The width of bar 16 between the arms 52 of the "U" is dimensioned so that three checkers can easily fit abreast in each row. Using a $1\frac{1}{2}$ inch diameter checker size, the space between the arms should be about 1 inch.

Slots 36 are cut into bar 16 at each end and serve to position bar 16 on base 22 via pins 34.

Ramp 42 is preferably fabricated from aluminum or other metal or plastic would serve equally as well. Game piece block 44 is also preferably aluminum. On the top surface of block 44 is v-shaped groove 46 which serves to store doubling die 65. Immediately adjacent on both sides of groove 46 is dice surface 48 which serves to store four dice 64 used in the game, two on each side. Block 44, ramp 42, spacer 40 is attached to bar 16 by a screw through hole 50.

Figure 6:
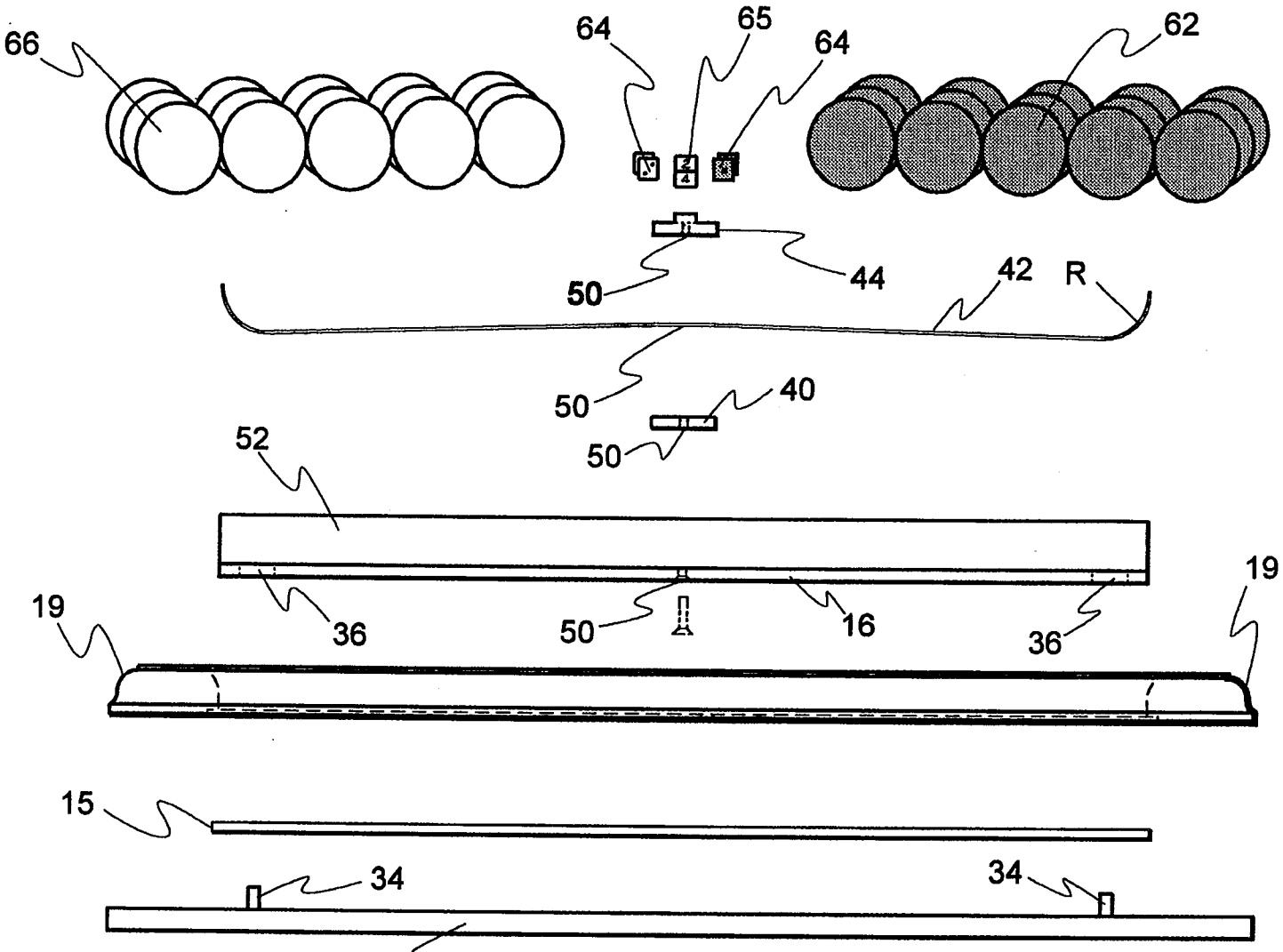
FIG. 6 is an exploded side view of the game board bar.

FIG. 6 is an exploded side cross-sectional view of the game board bar 16. Ramp 42 is higher in the center and declines as it approaches frame sections 19. Radius R is provided at both ends of ramp 42. Radius R is preferably about $\frac{3}{4}$ inches. In this manner, when one or more checkers 66 or 62 are removed from the row adjacent to the radiused end of ramp 42, another checker(s) in the same line will roll into place. Thus, a player will always have the checkers in easy reach of his/her side of the playing board.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A game board for playing the game of Backgammon comprising:

a base with a top surface; a rectangular frame with an inner perimeter; said frame attached to said base, said frame having a recess at the inner perimeter and adjacent to the top surface of said base; two flexible inserts, substantially identical, and dimensioned to correspond to the recess of said frame, wherein said inserts have a felt surface on one side and a laminate surface on the other, with both sides having Backgammon points; such that when said inserts are placed within the frame of said board, said inserts form a Backgammon playing surface that conforms to the commonly accepted format for Backgammon play.

2. A game board for playing the game of Backgammon comprising:

a base with a top surface; a rectangular frame with an inner perimeter; said frame attached to said base, said frame having a recess at the inner perimeter and adjacent to the top surface of said base; two flexible inserts, substantially identical, and dimensioned to correspond to the recess of said frame; two locating pins attached to said base between the inserts; a bar having two receiving openings corresponding to said locating pins, said bar being removably attachable to said base by means of said locating pins; such that when said inserts are placed within the frame of said board, and when said bar is placed on said base with said pins being placed within the receiving openings of said bar, said bar covers the joint between said inserts and said inserts form a Backgammon playing surface that conforms to the commonly accepted format for Backgammon play.

3. The game board of claim 2 wherein said bar further comprises:

a ramp dimensioned to hold Backgammon checkers three lines abreast in rows, said ramp higher at the center of said bar and declining toward the inner perimeter of opposing sections of said frame, such that when a player removes one or more checkers from the bar in the row closest to said perimeter, the same number of checkers removed will be automatically replaced from the adjacent row of checkers until all checkers in the line have been removed.

4. The game board of claim 3 wherein said bar further comprises a storage surface dimensioned to hold four dice and a doubling die.

* * * * *